US005335848A

United States Patent [19]

Schreiber

[11] Patent Number: 5,335,848

[45] Date of Patent: Aug. 9, 1994

[54] NEWSPAPER DELIVERY BOX SIGNALLING APPARATUS

[76] Inventor: Lewelyn R. Schreiber, 20 Obsidian Dr., Chambersburg, Pa. 17201

[21] Appl. No.: 65,477

[22] Filed: May 24, 1993

[51] Int. Cl.[5] ..... B65D 91/00

[52] U.S. Cl. ..... 232/34

[58] Field of Search ..... 232/34, 35; 40/218

[56] References Cited

U.S. PATENT DOCUMENTS

| | | | |
|---|---|---|---|
| 960,583 | 6/1910 | Reynolds | 232/34 |
| 969,038 | 8/1910 | Carmony | 232/34 |
| 1,123,647 | 1/1915 | Ackman | 232/34 |
| 1,307,242 | 6/1919 | Courtney | 232/34 |
| 1,334,106 | 3/1920 | Mackey | 232/34 |
| 2,496,962 | 2/1950 | Shaw | 232/34 |
| 2,801,046 | 7/1957 | Mirkin | 232/34 |
| 3,033,443 | 5/1962 | Barnes | 232/34 |
| 4,308,989 | 1/1982 | Elsinger | 232/34 |
| 4,651,135 | 3/1987 | Duhaime et al. | 232/34 |
| 4,860,949 | 8/1989 | Moore | 232/35 |
| 5,125,570 | 6/1992 | Jones | 232/34 |

*Primary Examiner*—Peter M. Cuomo
*Assistant Examiner*—Michael Milano

[57] ABSTRACT

A new and improved newspaper delivery box signalling apparatus includes a housing assembly for receiving and containing a delivered newspaper. The housing assembly includes a first opening for receiving the newspaper, and includes a second opening for permitting signalling of newspaper delivery. A delivery signal assembly is supported by the housing assembly and signals delivery of a newspaper. The delivery signal assembly includes a signal flag, a counterweight, and a lever/fulcrum assembly supporting the signal flag and the counterweight. When no newspaper is present in the housing assembly, the counterweight, through the lever/fulcrum assembly, positions the signal flag is the nondelivery position. However, when a newspaper has been delivered, the weight of the newspaper, through the lever/fulcrum assembly, overcomes the counterweight and moves the signal flag to the delivered position. In a first embodiment of the invention, the second opening of the housing assembly is located on a bottom wall of the housing assembly and is large enough permit the signal flag to move back and forth from a nondelivery mode to a delivery mode through the second opening in the bottom wall. In a second embodiment of the invention, the second opening of the housing assembly is located on a side wall of the housing assembly. In this embodiment, the lever/fulcrum assembly includes a control shaft which passes through the second opening and moves the signal flag, which is supported by the control shaft, back and forth from a nondelivery mode to a delivery mode.

9 Claims, 4 Drawing Sheets

NEWSPAPER DELIVERY BOX SIGNALLING APPARATUS

BACKGROUND OF THE INVENTION

1. Field of the Invention

The present invention relates generally to boxes for receipt of delivered newspapers, and more particularly, to a newspaper delivery box signalling apparatus especially adapted to provide a visible signal indicating that the newspaper has been placed in the newspaper delivery box.

2. Description of the Prior Art

Devices that signal the presence of delivered mail are well known in the art. For example, the following U.S. Pat. Nos. disclose mailbox signalling devices that indicate the presence or absence of delivered mail: 4,728,028; 4,896,624; 4,953,783; 4,978,057; and 5,040,723. All of the above-mentioned mailbox signalling devices are actuated by operation of the mailbox door. Mailboxes generally have mailbox doors because of postal regulations, because many mail items are small and easily whipped by the wind, and because of the desire to provide a degree of privacy and security for the delivered mail.

Newspaper boxes, on the other hand, generally do not have doors. This is so because no regulations require the presence of newspaper box doors. Moreover, the content of a newspaper is not private and does not warrant privacy protection. Furthermore, a newspaper is relatively heavy compared to some light items of mail. Moreover, the newspaper is sometimes wedged into the newspaper box because a particular edition of the newspaper is uncommonly thick. Without the presence of a door on newspaper delivery boxes, signalling devices that depend on operation of a door cannot be used. In this respect, it would be desirable if a newspaper delivery box could be provided which provides a signal indicating newspaper delivery without the presence of an actuating door.

It is noted that many of the mailbox signalling devices include complex linkages and mechanical structures. Not only are complex structures expensive to design and build. They are also readily subject to failure, considering the stressful environment of wind, rain, ice, and snow that such mailboxes may be subjected to. In this respect, it would be desirable if a delivery box were provided which signalled the presence of a newspaper but that used simple, inexpensive signalling structures.

Nowadays, many signalling devices depend upon electronic circuitry. However, in the environment of a newspaper delivery box, providing electricity and protecting the electrical components from rain and other precipitation may prove to be a very difficult problem. In this respect, it would be desirable if a newspaper delivery box signalling apparatus were provided that does not depend upon electronic circuitry.

Generally, a newspaper delivery box stands ready twenty-four hours in a day. Yet, it is generally used only a few hours a day if that much. All the remaining hours of the day, the box is subjected to environmental stresses even when the box is not in use. In this respect, relatively delicate signalling structures may be subject to environmental stresses many hours of the day and night when, in essence, the box is not in use. In this respect, it would be desirable if a newspaper delivery box were provided in which signalling structures were protected from environmental stresses when the box is not in use.

Complex mechanical signalling devices are especially subject to failure when they have a large number of moving parts. In this respect, it would be desirable if a newspaper delivery box were provided that contained only one moving part.

Many signalling devices that are used with mailboxes must be manually reset after each use. This is an inconvenient feature because a person often forgets to reset the device. If the person forgets, either the device is unusable, or the person must make a special trip to reset the device. In this respect, it would be desirable if a newspaper delivery box were provided which operates automatically and resets automatically, without requiring a person to reset it.

Thus, while the foregoing body of prior art indicates it to be well known to use mailboxes with mail delivery signalling devices, the prior art described above does not teach or suggest a newspaper delivery box signalling apparatus which has the following combination of desirable features: (1) provides a signal indicating newspaper delivery without the presence of an actuating door; (2) does not depend upon electronic signalling circuitry; (3) signals the presence of a newspaper with simple, inexpensive signalling structures; (4) protects signaling structures from environmental stresses when the box is not in use; (5) contains only one moving part; and (6) operates automatically and resets automatically, without requiring a person to reset it. The foregoing desired characteristics are provided by the unique newspaper delivery box signalling apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a new and improved newspaper delivery box signalling apparatus which includes a housing assembly for receiving and containing a delivered newspaper. The housing assembly includes a first opening for receiving the newspaper, and includes a second opening for permitting signalling of newspaper delivery. A delivery signal assembly is supported by the housing assembly and signals delivery of a newspaper. The delivery signal assembly includes a signal flag, a counterweight, and a lever/fulcrum assembly supporting the signal flag and the counterweight.

When no newspaper is present in the housing assembly, the counterweight, through the lever/fulcrum assembly, positions the signal flag is the nondelivery position. However, when a newspaper has been delivered, the weight of the newspaper, through the lever/fulcrum assembly, overcomes the counterweight and moves the signal flag to the delivered position.

In a first embodiment of the invention, the second opening of the housing assembly is located on a bottom wall of the housing assembly and is large enough permit the signal flag to move back and forth from a nondelivery mode to a delivery mode through the second opening in the bottom wall. In the first embodiment, the lever/fulcrum assembly includes a first lever arm for receiving weight of a delivered newspaper and for supporting the signal flag, a second lever arm connected to the first lever arm, a counterweight connected to the second lever arm, and a fulcrum for supporting the first lever arm and the second lever arm. The first lever arm includes a plate member for receiving weight of the newspaper. The counterweight and the second lever arm are located proximal to the first housing assembly opening, and the signal flag and the first lever arm are located distal to the first opening.

In a second embodiment of the invention, the second opening of the housing assembly is located on a side wall of the housing assembly. The lever/fulcrum assembly includes a control shaft which passes through the second opening and moves the signal flag, which is supported by the control shaft, back and forth from a nondelivery mode to a delivery mode. In the second embodiment, the lever/fulcrum assembly includes a first lever arm for receiving weight of a delivered newspaper, a control shaft connected to the first lever arm, a signal flag connected to the control shaft, a second lever arm connected to the first lever arm, a counterweight connected to the second lever arm, and a fulcrum for supporting the first lever arm and the second lever arm. The first lever arm includes a plate member for receiving weight of the newspaper.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least two preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved newspaper delivery box signalling apparatus which has all of the advantages of the prior art and none of the disadvantages.

It is another object of the present invention to provide a new and improved newspaper delivery box signalling apparatus which may be easily and efficiently manufactured and marketed. It is a further object of the present invention to provide a new and improved newspaper delivery box signalling apparatus which is of durable and reliable construction.

An even further object of the present invention is to provide a new and improved newspaper delivery box signalling apparatus which is susceptible of a low cost of manufacture with regard to both materials and labor, and which accordingly is then susceptible of low prices of sale to the consuming public, thereby making such newspaper delivery box signalling apparatus available to the buying public.

Still yet a further object of the present invention is to provide a new and improved newspaper delivery box signalling apparatus that provides a visible signal indicating newspaper delivery without the presence of an actuating door.

Still another object of the present invention is to provide a new and improved newspaper delivery box signalling apparatus that does not depend upon electronic signalling circuitry.

Yet another object of the present invention is to provide a new and improved newspaper delivery box signalling apparatus which provides a visual signal for the presence of a newspaper and that uses simple, inexpensive signalling structures.

Even another object of the present invention is to provide a new and improved newspaper delivery box signalling apparatus in which signalling structures are protected from environmental stresses when the box is not in use.

Still a further object of the present invention is to provide a new and improved newspaper delivery box signalling apparatus that contains only one moving part.

Yet another object of the present invention is to provide a new and improved newspaper delivery box signalling apparatus which operates automatically and resets automatically, without requiring a person to reset it.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

Figure 1:
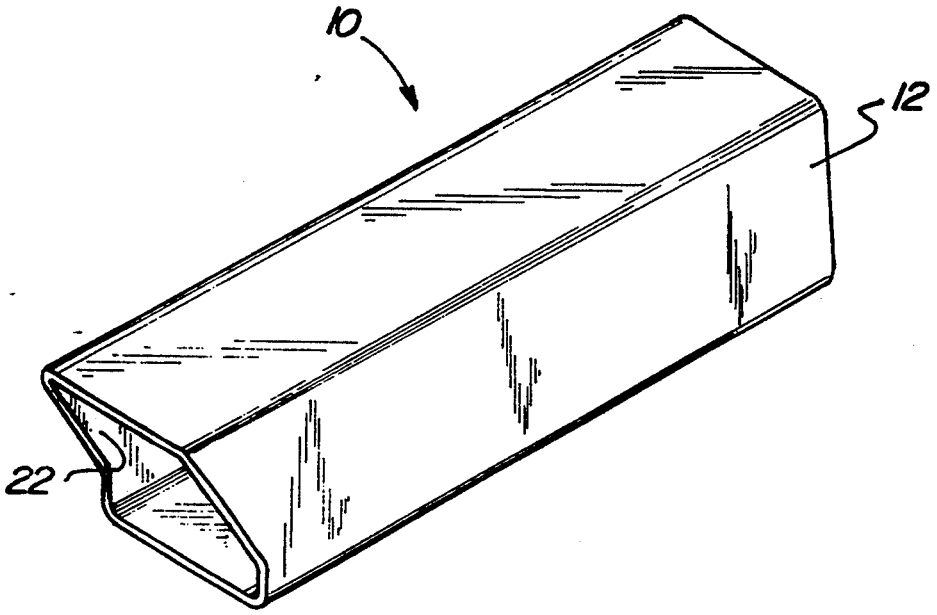
FIG. 1 is an elevated perspective view showing a first preferred embodiment of the newspaper delivery box signalling apparatus of the invention having a signal flag contained in the interior of the box when waiting for a newspaper.

With reference to the drawings, a new and improved newspaper delivery box signalling apparatus embodying the principles and concepts of the present invention will be described.

Turning initially to FIGS. 1–4, there is shown a first exemplary embodiment of the newspaper delivery box signalling apparatus of the invention generally designated by reference numeral 10. The newspaper delivery box signalling apparatus 10 includes a housing assembly 12 for receiving and containing a delivered newspaper (not shown). The housing assembly 12 may be a conventional newspaper box modified as indicated below for purposes of carrying out the present invention. The housing assembly 12 includes a first opening 22 for receiving the newspaper and includes a second opening 23 for permitting signalling of newspaper delivery. The second opening 23 may be formed in a conventional delivery box by cutting out a suitable portion of the bottom wall thereof. A delivery signal assembly 14 is supported by the housing assembly 12 and signals delivery of a newspaper. The delivery signal assembly 14 includes a signal flag 24, a counterweight 27, and a lever/fulcrum assembly supporting the signal flag 24 and the counterweight 27. The second opening 23 of the housing assembly 12 is located on a bottom wall 30 of the housing assembly 12 and is large enough permit the signal flag 24 to move back and forth from a nondelivery mode to a delivery mode through the second opening 23 in the bottom wall 30.

Figure 3:
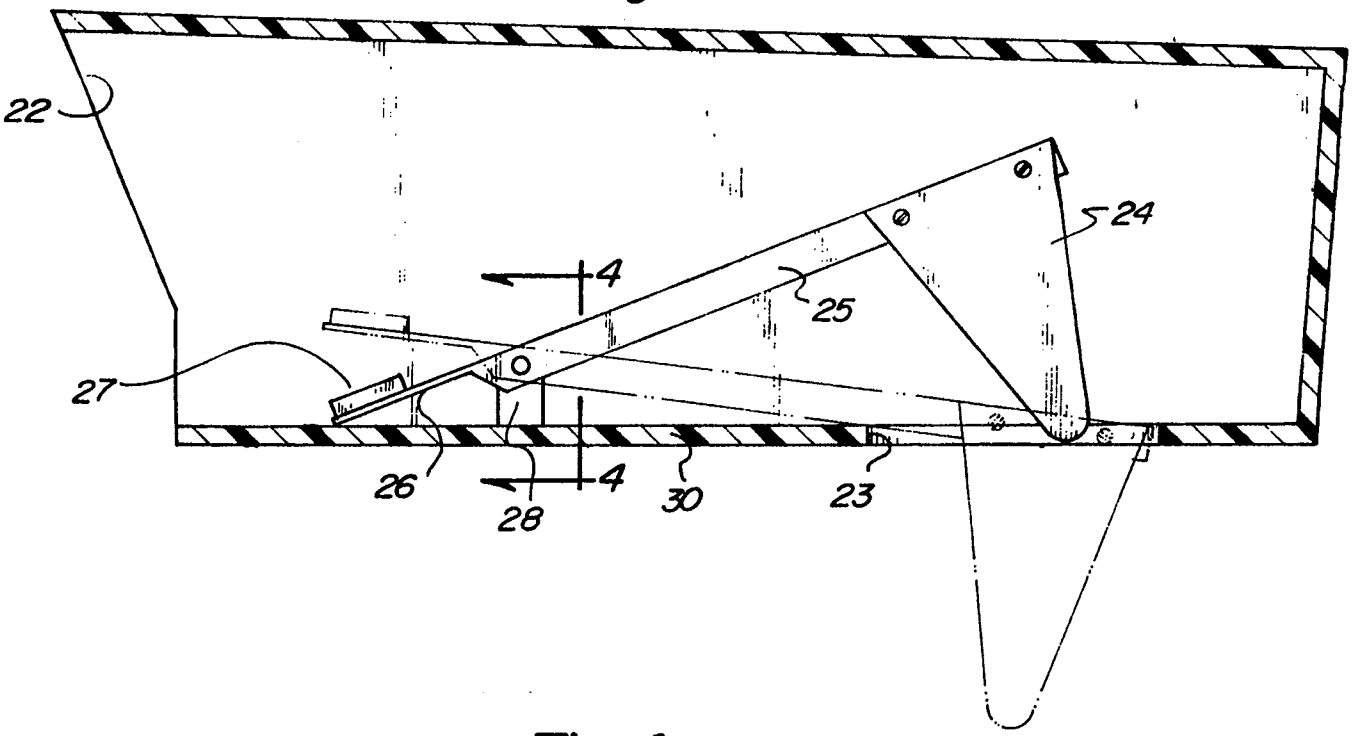
FIG. 3 is a cross-sectional view of the newspaper delivery box signalling apparatus of FIG. 2 taken along line 3—3 thereof.
Figure 4:
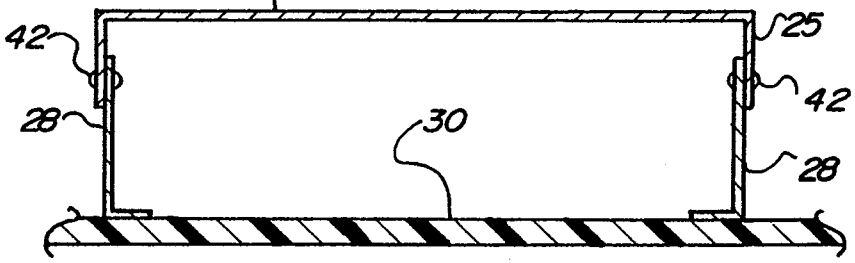
FIG. 4 is a partial cross-sectional view of the embodiment shown in FIG. 3 taken along the line 4—4 thereof.

In FIG. 3, the nondelivery mode of the signal flag 24 is shown in solid lines. In this mode, the counterweight 27, pulled by gravity, rests upon the inside bottom surface of the housing assembly 12, and, through the lever/fulcrum assembly, the signal flag 24 is elevated to be retained in the interior of the housing assembly 12. The delivery mode of the signal flag 24 is shown in dotted outline. In the delivery mode, the weight of the delivered newspaper (not shown) weighs down the first lever arm 25, overcoming the weight of the counterweight 27; and the signal flag 24 is moved to outside the housing assembly 12.

Figure 2:
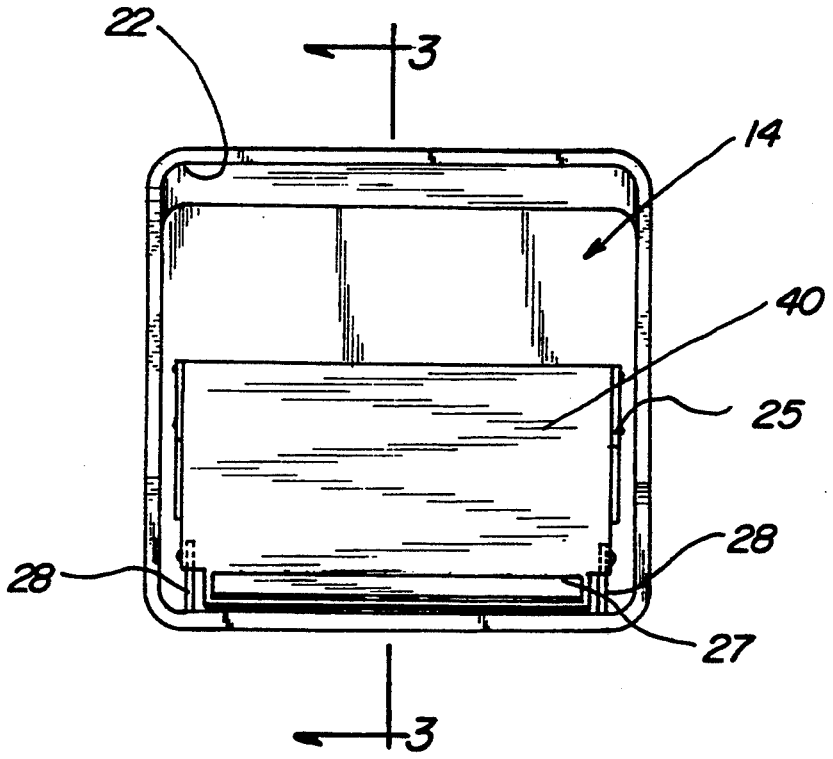
FIG. 2 is an enlarged front view, looking into the interior of the first embodiment of the newspaper delivery box signalling apparatus shown in FIG. 1.

More specifically, the lever/fulcrum assembly include a first lever arm 25 for receiving weight of a delivered newspaper and for supporting the signal flag 24. A second lever arm 26 is connected to the first lever arm 25; and a counterweight 27 is connected to the second lever arm 26. A fulcrum 28 includes a pair of swivel assemblies 42 which support the first lever arm 25 and the second lever arm 26. The first lever arm 25 includes a plate member 40 for receiving weight of the newspaper. The top surface of plate member 40 is shown in FIG. 2. In lieu of swivel assemblies 42, the first lever arm (plate 40) and the second lever arm may be affixed to a transverse rod (not shown) which latter is suitably mounted on fulcrums 28 for pivotal movement about an axis passing through the fulcrums parallel to bottom wall 30.

As shown in FIG. 3, the counterweight 27 and the second lever arm 26 are located proximal to the first housing assembly opening 22, and the signal flag 24 and the first lever arm 25 are located distal to the first opening 22.

Figure 5:
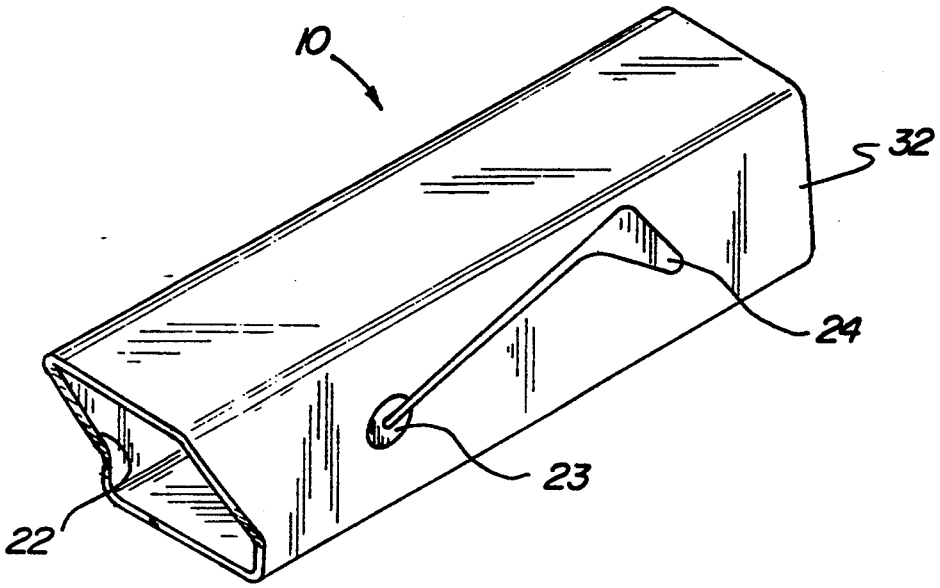
FIG. 5 is an elevated perspective view showing a second preferred embodiment of the newspaper delivery box signalling apparatus of the invention having a signal flag located outside of the box when waiting for a newspaper.
Figure 6:
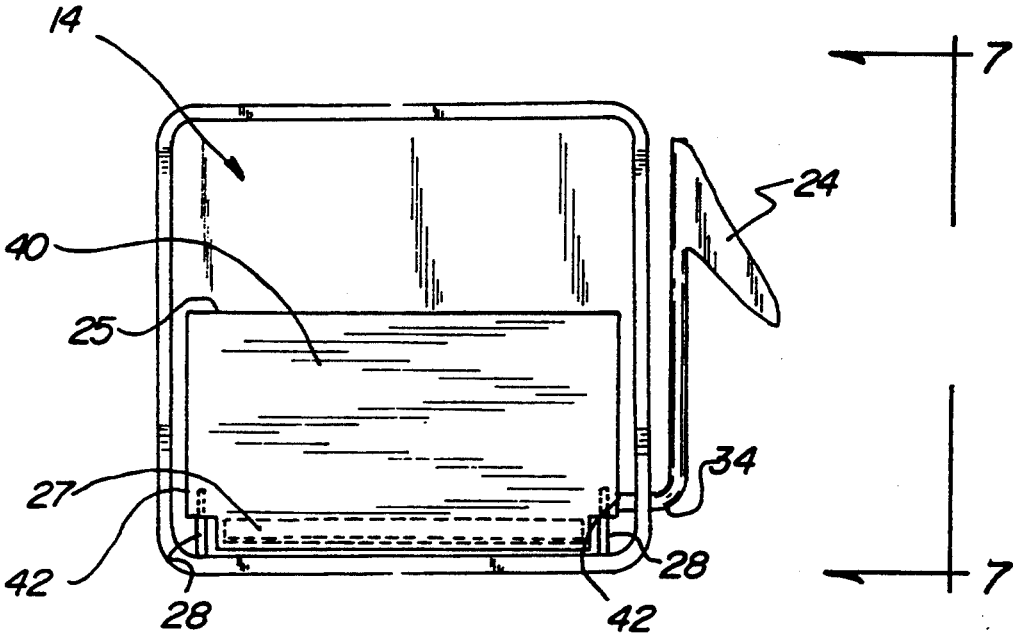
FIG. 6 is an enlarged front view, looking into the interior of the second embodiment of the newspaper delivery box signalling apparatus shown in FIG. 5.
Figure 7:
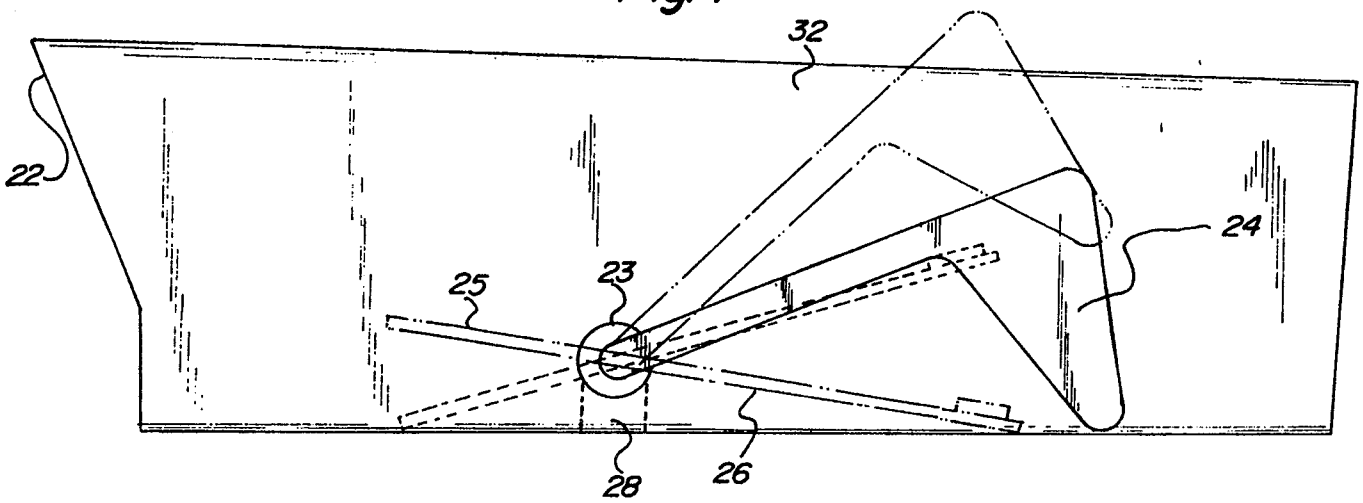
FIG. 7 is a cross-sectional view of the newspaper delivery box signalling apparatus of FIG. 6 taken along line 7—7 thereof.

Turning to FIGS. 5–7, a second embodiment of the newspaper delivery box signalling apparatus of the invention is shown. Reference numerals are shown that correspond to like reference numerals that designate like elements shown in the other figures. In addition, the second opening 23 of the housing assembly 12 is located on a side wall 32 of the housing assembly 12. The lever/fulcrum assembly includes a control shaft 34 which passes through the second opening 23 for moving the signal flag 24, supported by the control shaft 34, back and forth from a nondelivery mode to a delivery mode.

More specifically, the lever/fulcrum assembly includes a first lever arm 25 for receiving weight of a delivered newspaper. A control shaft 34 is connected to the first lever arm 25. The signal flag 24 is connected to the control shaft 34. A second lever arm 26 is connected to the first lever arm 25. A counterweight 27 is connected to the second lever arm 26, and a fulcrum 28 supports the first lever arm 25 and the second lever arm 26. The first lever arm 25 includes a plate member 40 for receiving weight of the newspaper.

In FIG. 7, the nondelivery mode of the signal flag 24 is shown in solid lines. In this mode, the counterweight 27, pulled by gravity, rests upon the inside bottom surface of the housing assembly 12, and, through the lever/fulcrum assembly, the signal flag 24 is in a relative low position with respect to the side wall 32 of the housing assembly 12. In contrast, the delivery mode of the signal flag 24 is shown in dotted outline. In the delivery mode, the weight of the delivered newspaper (not shown) weighs down the first lever arm 25, overcoming the weight of the counterweight 27; and the signal flag 24 is moved to the elevated position with respect to the side wall 32. It will be appreciated that although the signal flag 24 is shown extending through the right side wall of the housing assembly 12 as viewed in FIG. 5, it may, if desired, alternatively be arranged to extend instead through the other or opposed sidewall of the housing assembly as will obviously occur to the skilled artisan.

Figure 8:
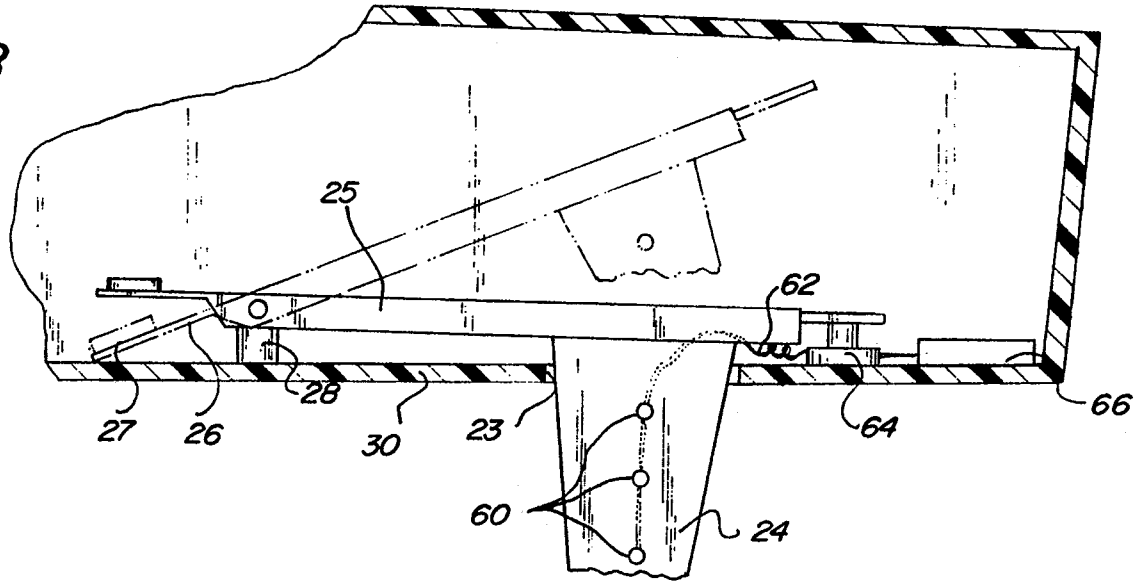
FIG. 8 is a cross-sectional view of the newspaper delivery box signalling apparatus of the invention modified to include the addition of a light signalling subassembly.

Turning finally to FIG. 8, the embodiment of FIGS. 1 through 4 is further modified to include one or more illumination means in the form of small light bulbs or lamps are mounted on flag 24 substantially as depicted. The lights 60 are connected through wire 62 to a contact switch 64 which, in turn, is connected to a suitably battery 66. When the flag is moved to its signaling position by the weight of a newspaper, the contact switch is activated to illuminate bulbs 60 thereby to enhance the "newspaper delivered" signal. Removal of the newspaper causes the flag to move to its non-activated position deactivating the contact switch and turning off the illumination means 60. The alternative embodiment of FIGS. 5 through 7 may be simmilary modified to include the illumination signal enhancement circuit of FIG. 8.

The components of the newspaper delivery box signalling apparatus of the invention can be made from inexpensive and durable metal or plastic materials.

It is apparent from the above that the present invention accomplishes all of the objects set forth by providing a new and improved newspaper delivery box signalling apparatus that is low in cost, simple in design and operation, and which may advantageously be used to automatically signal the presence of a delivered newspaper. More specifically, the newspaper delivery box signalling apparatus of the invention provides a visible signal indicating newspaper delivery without the presence of an actuating door. With the invention, a signalling apparatus is provided that does not depend upon electronic signalling circuitry. With the invention, a newspaper delivery box which signals the presence of a newspaper is provided that uses simple, inexpensive signalling structures. With the invention, a newspaper delivery box is provided in which signalling structures are protected from environmental stresses when the box is not in use. With the invention, a newspaper delivery box is provided that contains only one moving part. With the invention, a newspaper delivery box is provided which operates automatically and resets automatically, without requiring a person to reset it. With the invention, a newspaper delivery box is provided in which signalling structures avoid the use of springs which may fatigue after repeating use.

With respect to the above description, it should be realized that the optimum dimensional relationships for the parts of the invention, to include variations in size, form function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only be the broadest interpretation of the appended claims so as to encompass all such modifications and equivalents.

What is claimed as being new and desired to be protected by Letters Patent of the United States is as follows:

1. A new and improved newspaper delivery box signalling apparatus, comprising:

housing assembly means for receiving and containing a delivered newspaper, said housing assembly means including a first opening for receiving the newspaper, and including a second opening for permitting signalling of newspaper delivery, and delivery signal assembly means, supported by said housing assembly means, for signalling delivery of a newspaper, said delivery signal assembly means including a signal flag, a counterweight, and a lever/fulcrum assembly supporting said signal flag and said counterweight.

further including light signaling means on said flag, electrical power means for selectively energizing the light signaling means, and contact switch means responsive to said delivery signal means for connecting said power means to said light signaling means in order to energize said light signaling means.

2. The apparatus described in claim 1 wherein said second opening of said housing assembly means is located on a bottom wall of said housing assembly means and is large enough permit said signal flag to move back and forth from a nondelivery mode to a delivery mode through said second opening in said bottom wall.

3. The apparatus described in claim 1 wherein said lever/fulcrum assembly include a first lever arm for receiving weight of a delivered newspaper and for supporting said signal flag, a second lever arm connected to said first lever arm, a counterweight connected to said second lever arm, and a fulcrum for supporting said first lever arm and said second lever arm.

4. The apparatus described in claim 3 wherein said first lever arm includes a plate member for receiving weight to of the newspaper.

5. The apparatus described in claim 4 wherein:

said counterweight and said second lever arm are located proximal to said first housing assembly meas opening, and said signal flag and said first level arm are located distal to said first opening.

6. The apparatus described in claim 1 wherein:

said second opening of said housing assembly means is located on a side wall of said housing assembly means, said lever/fulcrum assembly includes a control shaft which passes through said second opening for moving said signal flag, supported by said control shaft, back and forth from a nondelivery mode to a delivery mode.

7. The apparatus described in claim 1 wherein said lever/fulcrum assembly includes a first lever arm for receiving weight of a delivered newspaper, a control shaft connected to said first lever arm, said signal flag connected to said control shaft, a second lever arm connected to said first lever arm, a counterweight connected to said second lever arm, and a fulcrum for supporting said first lever arm and said second lever arm.

8. The apparatus described in claim 7 wherein said first lever arm includes a plate member for receiving weight of the newspaper.

9. The apparatus described in claim 7 wherein said contact switch means is positioned inside said housing so as to be activated by said first lever.

* * * * *